United States Patent [19]

Hedeen

[11] 4,024,969

[45] May 24, 1977

[54] MULTIPLE CABLE SUSPENSION ASSEMBLY

[75] Inventor: Nils E. Hedeen, Mequon, Wis.

[73] Assignee: Harnischfeger Corporation, W. Milwaukee, Wis.

[22] Filed: Feb. 24, 1976

[21] Appl. No.: 660,851

Related U.S. Application Data

[63] Continuation of Ser. No. 548,296, Feb. 10, 1975, abandoned.

[52] U.S. Cl. ..... 214/135 R; 14/22; 248/324

[51] Int. Cl.[2] ..... E02F 3/75

[58] Field of Search ..... 214/135 R, 135 A, 138; 212/58 A, 59; 187/1, 1 A; 248/317, 324; 114/215; 14/19, 20, 22

[56] References Cited

UNITED STATES PATENTS

| | | | |
|---|---|---|---|
| 1,891,115 | 12/1932 | Scott | 181/1 |
| 2,385,488 | 9/1945 | Beatty | 187/1 A |
| 3,160,298 | 12/1964 | Talley | 214/135 R |
| 3,228,535 | 1/1966 | Butcher | 212/59 R |
| 3,501,034 | 3/1970 | Baron | 214/138 |
| 3,580,405 | 5/1971 | Siegel | 214/135 R |

*Primary Examiner*—L. J. Paperner
*Assistant Examiner*—Ross Weaver
*Attorney, Agent, or Firm*—James E. Nilles

[57] ABSTRACT

A multiple cable suspension means for connecting the boom point of an earth moving shovel to a rigid gantry. The apparatus generally consists of four cables of predetermined length, an assembly for connecting the cables to the boom point and an assembly for connecting the cables to the gantry. The assemblies connecting the cables to the boom point and the gantry are generally pivotable in such a manner as to equalize the tensile stresses acting on the four cables such that, even if the cables are not of exactly the same length, the tensile stresses will be evenly distributed. The equalizer assembly connecting the four cables to the gantry comprises two plates which are horizontally spaced and which are pivotable around a horizontal axis, each one having two cable ends connected to it. The equalizer assembly connecting the four cables to the boom point similarly generally comprises two spaced apart plates which are connected to the boom point in such a manner that they are pivotable around a horizontal axis. In order to equalize the stresses, each of the two cables which are attached to the same equalizer plate of the equalizer assembly at the gantry are attached to separate plates of the equalizer assembly at the boom point, and the two cables which are attached to the same equalizer plates at the boom point are attached to separate equalizer plates at the gantry. This arrangement of the cables in conjunction with facility of the equalizer plates to pivot compensates for cables of slightly different lengths such that the tensile stresses on the cables resulting from a load being placed on the boom are evenly distributed to all four cables.

13 Claims, 2 Drawing Figures

MULTIPLE CABLE SUSPENSION ASSEMBLY

REFERENCE TO RELATED CO-PENDING APPLICATION

This is a continuation application from my co-pending U.S. patent application, Ser. No. 548,296, filed Feb. 10, 1975 now abandoned and entitled "Multiple Cable Suspension Assembly."

BACKGROUND OF THE INVENTION

The present invention pertains to a multiple cable suspension system used to support the boom extending from an earth moving shovel. The invention is particularly applicable to such shovels which are used in mining ore where the shovels used are massive and the booms are required to support enormous weights. In such mining shovels the boom is generally pivotably supported at its lower end by the base of the shovel and is supported at its extended end by suspension cables secured to a rigid gantry.

When a plurality of suspension cables are used it is desirable to have the load on the cables evenly distributed between the cables, and therefore each of the cables must be exactly the same length or means must be provided to compensate for differences in the lengths of the cables.

It has proved desirable in some applications to use preformed cable assemblies having predetermined lengths and including sockets at each end to facilitate relatively easy connection to the boom and gantry. Suspension cables of such fixed lengths have been used in the prior art, but some problems have remained because the cable assemblies including sockets attached to each end cannot be fabricated in lengths having tolerances of less than plus or minus one-fourth of an inch, such tolerances thereby allowing two cables to differ in length by as much as one-half of an inch. When cables are used having such discrepancies in length, the shorter cables absorb the tensile stress, and the remainder of the cables are slack. As is readily apparent, these drawbacks are particularly acute when the boom is of such size as to require the use of four suspension cables rather than merely two.

In the prior art, attempts have been made to provide means for attaching the cables to the boom and the gantry to compensate for diversities of length of the cables. However, the prior art apparatus has proved to be somewhat complicated and costly.

SUMMARY OF THE INVENTION

The present invention is intended to provide a simpler means for connecting four suspension cables of fixed lengths to the boom point and to the gantry of a mining shovel in such a manner that the tensile stresses applied to each of the cables are equal. The assemblies of the present invention are also intended to provide apparatus rendering a solution to the problem which are relatively less expensive to produce and thereby facilitating substantial savings during the production of the assemblies.

The suspension cables themselves generally comprise cables of a predetermined length having sockets attached at each end which facilitate the cable being pivotably attached to the assemblies.

One end of the four cables is attached to the boom point by means of an equalizer assembly which is a generally pivotable connection. The equalizer assembly consists of two equalizer plate members which are pivotably mounted to the boom point shaft, and which includes bores for being pivotably connected to the socket ends of two of the suspension cables.

The other end of the cables is attached to the gantry by an equalizer assembly substantially similar to that at the boom point. The two equalizer plate members are attached in horizontally spaced relation at either end of a horizontal shaft fixed to the upper part of the gantry, the equalizer members being mounted on the shaft so as to be pivotable about a horizontal axis. As with the equalizer members connected at the boom point, each of the equalizer members is provided with bores for being connected to two of the suspension cables such that the socket end of the cable is generally pivotable about a horizontal axis passing through the equalizer member.

The cables are attached to the equalizer members in such a manner that the two cables attached to one of the equalizer plate members connected to the gantry are attached to separate equalizer members at the boom point and two cables attached to the same equalizer member at the boom point are attached to separate equalizer members at the gantry.

Using this arrangement of the suspension cables in conjunction with the independently pivotable equalizer members facilitates minor self-adjustment of the positions of the equalizing members and the cables when a load is applied to the boom such that, even though the cables may be of slightly different lengths, the tensile stress is evenly distributed between the cables.

The structure of the equalizing assemblies is also a substantial advance over prior art showing the use of fixed length cables because it is much less complicated than any other such system shown in the prior art and is consequently less expensive and easier to manufacture and assemble.

DESCRIPTION OF THE PREFERRED EMBODIMENT

Figure 1:
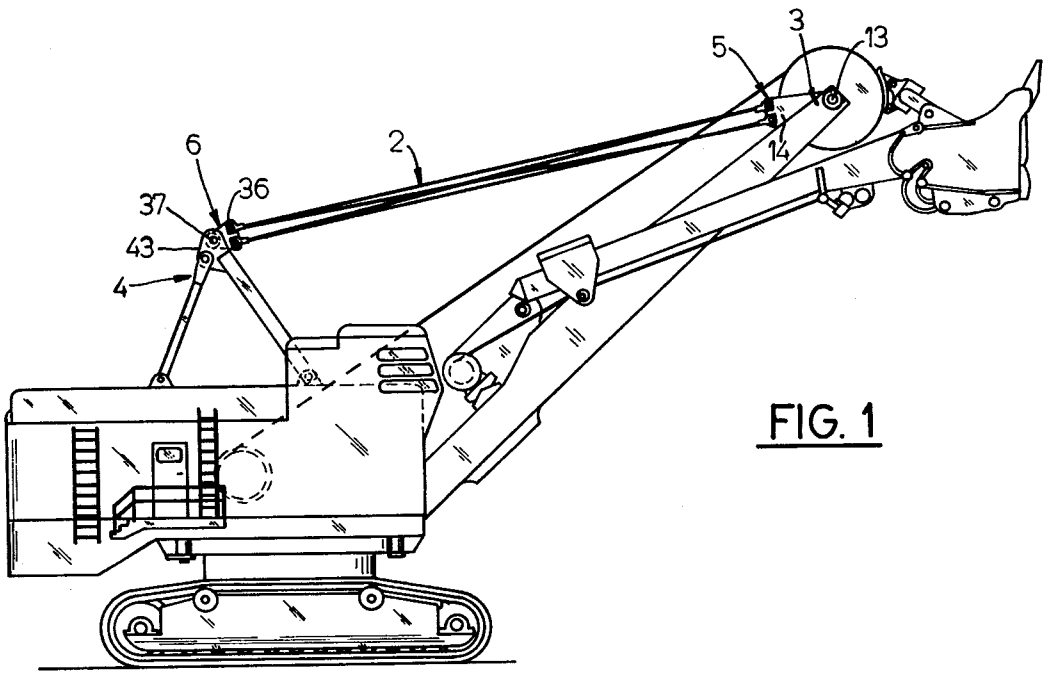
FIG. 1 is a side elevation of a mining shovel illustrating the use of the multiple suspension cable apparatus of the present invention.

FIG. 1 illustrates a mining shovel employing a suspension cable assembly which comprises one particular embodiment of the present invention as a means for supporting the shovel boom. The suspension cable assembly 2 generally consists of four cables 7, 8, 9 and 10 extending between the boom point 3 and the gantry 4. The cables are attached at one end to the boom point 3 by a first equalizer assembly 5 and at the other end to the gantry 4 by a second equalizer assembly 6 in such manner that, even though the four suspension cables 7 – 10 may be of slightly different lengths, the tensile stresses on the cables resulting from a load being placed on the boom are generally evenly distributed.

Figure 2:
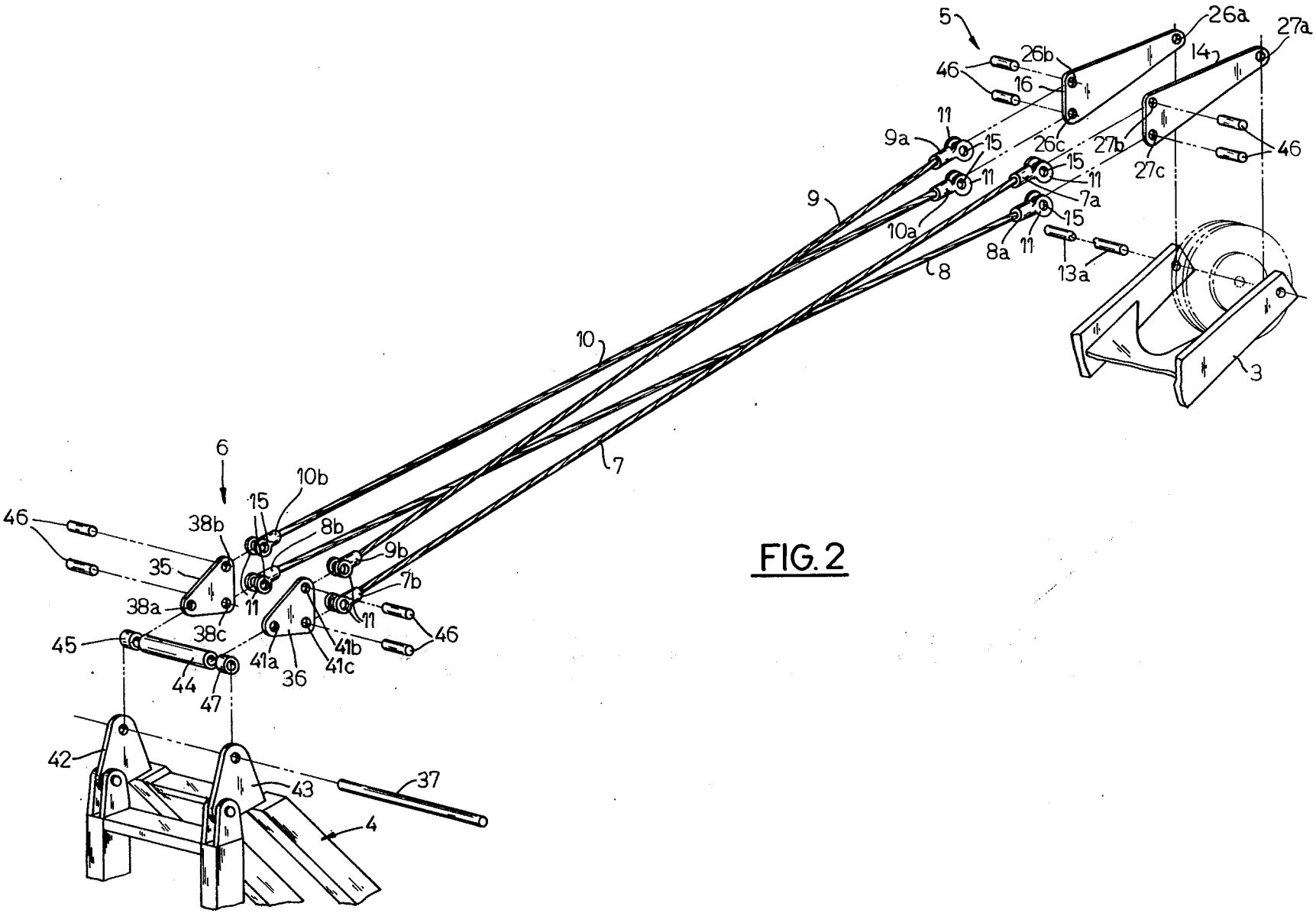
FIG. 2 is an exploded detailed view of the multiple suspension cable apparatus of the present invention.

FIG. 2 is an exploded view of a preferred embodiment of the suspension cable assembly of the invention. The apparatus shown should not be considered in any way as limiting the invention, but is shown only for purposes of example. The figure shows a specific arrangement of the four cable members 7 – 10 and in greater detail the means by which the cable members are connected by the first equalizer assembly 5 to the boom point 3 and by the second equalizer assembly 6 to the gantry 4.

CABLE MEMBERS

The four cable members 7 – 10 shown in FIG. 2 are each of a fixed length and include sockets 7*a*, 8*a*, 9*a* and 10*a* and 7*b*, 8b, 9*b* and 10*b* at each end. The sockets 7*a* – 10*a* and 7*b* – 10*b* each include a pair of axially extending spaced projections 11, said projections having bores 15 extending therethrough, the bores 15 extending through the two projections 11 of each socket and being in axial alignment so as to accommodate pivot pins, as more specifically described hereinafter.

BOOM POINT EQUALIZER ASSEMBLY

The four suspension cables 7 – 10 are connected to the boom point 3 by the equalizer assembly 5. The equalizer assembly 5 generally consists of a pair of equalizer plate members 14 and 16 pivotably connected to the boom point shaft 13. The equalizer plate members are generally flat steel plates having a generally triangular configuration and each including three bores generally positioned at the angles of the triangularly shaped plates, the equalizer plate member 16 including bores 26*a*, 26*b* and 26*c* and the equalizer plate member 14 including bores 27*a*, 27*b* and 27*c*.

The bores 26*a* and 27*a* of the respective equalizer plate members each receive the boom point shaft therethrough such that the plates 14 and 16 are spaced apart horizontally on each end of the shaft 13 and pivotable about its axis. The bores 26*b* and 26*c* of equalizer plate 16 and the bores 27*b* and 27*c* of the plate 14 are to facilitate pivotable connection of the equalizer plate members to the sockets of the cables as will be set forth hereafter.

GANTRY EQUALIZER ASSEMBLY

The four suspension cables 7 – 10 are connected at their other ends by an equalizer assembly 6 to the gantry 4. The equalizer assembly 6 generally comprises two horizontally spaced equalizer plate members 35 and 36 which are generally pivotable around a horizontally disposed gantry shaft 37 which extends through two upwardly extending plates 42, 43 secured to the gantry 4. The equalizer members 35 and 36 comprise generally flat, triangularly-shaped plates, equalizer member 35 having bores 38*a*, 38*b* and 38*c* and equalizer member 36 having similar bores 41*a*, 41*b* and 41*c*. The bores 38*a* and 41*a* of the equalizer plates each receive the shaft 37 such that the equalizer members are pivotable about the axis of the shaft 37. Furthermore, the equalizer members 35 and 36 are maintained in horizontally spaced relationship on shaft 37 by an annular cylinder member 44 surrounding shaft 37 and extending between the equalizer members 35 and 36, and by the bushings 45 and 47 surrounding the shaft 37 and located between the equalizer plates and the plates 42, 43 supporting the shaft.

The bores 38*b* and 38*c* in equalizer member 35 and the bores 41*b* and 41*c* in equalizer member 36 are provided to facilitate pivotable connection of the equalizer plate members to the sockets of the ends of the cables 7 – 10 as will be set forth.

CABLE ASSEMBLY RELATIONSHIP

As previously set out, the boom point 3 and the gantry are each pivotably connected to equalizer assemblies, and the respective equalizer assemblies 5 and 6 are, in turn, pivotably connected to opposite ends of cables 7 – 10 by the equalizer plate members 14, 16, 35 and 36. Each of the equalizer plate members are pivotably attached to two of the cable socket ends by pivot pins 46 extending through aligned bores in the equalizer plate members and in the projections 11 of the sockets. For example, the equalizer plate member 14 is received between the projections 11 of socket ends 7*a* and 8*a* such that the bores 27*b* and 27*c* of the equalizer plate member are in alignment with bores 15 of the projections 11 so as to receive pivot pins 46.

The fact that the cables are pivotably attached to the equalizer plates, operates in conjunction with the arrangement of the cables with respect to each other and with respect to the plates so as to give the multiple cable assembly of the present invention the inherent capability of compensating for any differential in the length of the cables such that the stresses placed on the cables when a load is applied to the boom are equally distributed. Generally, the suspension cables are arranged such that two cables are attached to each of the equalizer plate members at the boom point, the two cables attached to each of the equalizer plate members at the boom point each, in turn, being attached to different equalizer members at the gantry. As a correlary, the two cables attached to each of the equalizer plate members at the gantry are each attached to different equalizer plate members at the boom point. More specifically, at the boom point, equalizer plate member 14 has cables 7 and 8 attached thereto, these cables being attached to equalizer plate members 36 and 35 at their other ends. Equalizer plate member 16 is connected to cables 9 and 10, which cables are, in turn, connected to equalizer plate members 35 and 36 at their other ends. Equalizer plate member 35 at the gantry has cables 8 and 10 attached thereto, these cables being attached to equalizer plate members 14 and 16 at the boom point, and finally equalizer plate members 14 and 16, respectively at the boom point. This arrangement of the cables prevents any two cables from being connected to the same equalizer plate member at both ends and thereby avoids slack in one of the cables when the other is stressed in the event that the cables are of slightly different lengths.

It should be noted that the specific configuration of the cables shown in FIG. 2 illustrates that two of the cables cross in a vertical direction with the other two of the cables which, in turn, cross in a horizontal direction with respect to said first two cables and that none of the cables connected in this fashion are parallel to any of the other cables.

RESUME

The multiple cable suspension means of the present invention facilitates the use of cables having fixed lengths and socket ends in the boom supporting assembly on earth moving shovels. The use of such cables is advantageous because it substantially increases the ease with which such cables are attached to the boom and the gantry. The apparatus of the instant invention allows the use of fixed length cables by providing means for compensating for slight variances in the lengths of the cables such that the tensile stresses on the cables are evenly distributed even though some of the cables may be of slightly different lengths than others. The present invention is a further advance over the art by providing such an equalizing assembly which is uncomplicated, economical to manufacture and relatively easy to assemble.

I claim:

1. A multiple cable suspension means for connection between two spaced apart structures and comprising, four suspension cables of fixed approximately equal length extending between said two spaced apart structures, each cable extending in a straight line between said two spaced apart structures and no cable being parallel with another, and compensating means for compensating for differences in the lengths of said cables and for substantially equalizing the tensile stresses applied to said cables, said compensating means including a first pair of equalizer members spaced apart and pivotably connected to one of said structures, and a second pair of equalizer members spaced apart from one another and pivotably connected to the other of said structures and in alignment with said first mentioned pair, each of said equalizer members being independently pivotable, each of said cables including opposite ends, each of said ends being connected to at least one of said equalizer members, said equalizer members connecting said cables to said structures, two of said cables being connected to one of said first pair of equalizer members and being connected to both of said second pair of equalizer members and the other two of said cables being connected to the other equalizer member of said first pair and to both of said second pair of equalizer members whereby the tension in all four of said cables between said structures is maintained equal.

2. The cable suspension means set forth in claim 1 wherein said first pair of equalizer members are spaced apart horizontally and independently pivotable about a horizontal axis, and said second pair of equalizer members are likewise spaced apart horizontally and independently pivotable about a horizontal axis.

3. The cable suspension means set forth in claim 1 wherein said four suspension cables have sockets at each end, said sockets being pivotably connected to said first and second equalizer members.

4. The cable suspension means set forth in claim 1 wherein said equalizer members comprise flat plates.

5. A multiple cable suspension means for connection between two spaced apart structures and comprising, four suspension cables of fixed approximately equal length extending between said two spaced apart sturctures, each cable extending in a straight line between said two spaced apart structures and no cable being parallel with another, and compensating means for compensating for differences in the lengths of said cables and for substantially equalizing the tensile stresses applied to said cables, said compensating means including a first pair of equalizer members spaced apart and pivotably attached on one of said structures for pivotal movement about a first axis, and a second pair of equalizer members spaced apart from one another and pivotably attached to the other of said structures and in alignment with said first mentioned pair, said second pair of equalizer members being pivotable about an axis parallel to said first axis, each of said equalizer members being independently pivotable, each of said cables including opposite ends, each of said ends being connected to at least one of said equalizer members, said equalizer members connecting said cables to said structures such that two of said cables between said aligned pairs of equalizer members cross in a vertical direction plane and the other two of said cables cross in a horizontal plane, whereby the tension in all four of said cables between said structures is maintained equal.

6. The cable suspension means set forth in claim 6 wherein said four suspension cables have sockets at each end, said sockets being pivotably connected to said first and second equalizer members, and wherein said equalizer plates comprise flat plates including a plurality of horizontally extending bores.

7. A multiple cable suspension means for connection between two spaced apart structures and comprising, four suspension cables of fixed approximately equal length extending between said two spaced apart structures, each cable extending in a straight line between said two spaced apart sturctures and no cable being parallel with another, and compensating means for compensating for differences in the lengths of said cables and for substantially equalizing the tensile stresses applied to said cables, said compensating means including a first pair of equalizer members spaced apart and pivotably attached to one of said structures, and a second pair of equalizer members spaced apart from one another and pivotably attached to the other of said structures and in alignment with said first mentioned pair, each of said equalizer members being independently pivotable, each of said cables including opposite ends, each of said ends being connected to at least one of said equalizer members, said equalizer members connecting said cables to said structures, the arrangement of said equalizer members and said cables being such that one pair of cables is connected to one of said first pair of equalizer members, and said pair of cables is connected at its other end to both of said second pair of equalizer members, the other pair of cables being connected at one of its ends to the other equalizer member of said first pair and connected at its other end to both of said second pair of equalizer members, whereby two of said cables between said aligned pairs of equalizer members cross in a vertical direction, and the other two of said cables cross in a horizontal direction, whereby the tension in all four of said cables between said structures is maintained equal.

8. The multiple cable suspension means of claim 7 further characterized by each of said equalizer members being independently pivotable about a horizontal axis.

9. A multiple cable suspension means for connection between the boom point and the gantry of an earth moving shovel and for supporting said boom point, said suspension means comprising: four suspension cables of approximately equal fixed length connected to and extending between said boom point and said gantry, each cable extending in a straight line between said boom point and said gantry and no cable being parallel with another, and compensating means for compensating for differences in the lengths of said cables and for substantially equalizing the tensile stresses applied to said cables, said compensating means including a first equalizer assembly means connecting said suspension cables to said boom point and a second equalizer assembly means connecting said suspension cables to said gantry, and first equalizer assembly means including a pair of equalizer members independently pivotably connected in spaced apart relation to said boom point, said second equalizer assembly means including a pair of equalizer members independently pivotable about an axis and connected in spaced apart relation to said gantry, wherein each of said cables includes opposite ends, each of said ends being connected to at least one of said equalizer members and wherein each of the equalizer members is connected to two cables, the two cables attached to one of the equalizer members connected to the boom point being attached to separate equalizer members connected to the gantry and the two cables attached to one of the equalizer members connected to the gantry being attached to separate equalizer members connected to the boom point.

10. A multiple cable suspension means for connection between the boom point and the gantry of an earth moving shovel and comprising, four suspension cables of fixed approximately equal length extending between said boom point and said gantry, each cable extending in a straight line between the said boom point and said gantry and no cable being parallel with another, and compensating means for compensating for differences in the lengths of said cables and for substantially equalizing the tensile stresses applied to said cables, said compensating means including a first pair of equalizer members spaced apart in a generally horizontal direction and pivotably connected to said boom point for pivotal movement about a first axis, and a second pair of equalizer members spaced apart from one another in a generally horizontal direction and pivotably attached to said gantry and in alignment with said first mentioned pair, said second pair of equalizer members being pivotable about an axis parallel to said first axis, each of said cables including opposite ends, each of said ends being connected to at least one of said equalizer members, said suspension cables connected to and extending between said pairs of equalizer members on said structures, such that two of said cables between said aligned pairs of equalizer members cross in a vertical direction with the other two of said cables, and the other two of said cables cross in a horizontal direction with respect to said first two cables, whereby the tension in all four said cables between said structures is maintained equal.

11. The cable suspension means set forth in claim 10 wherein said four suspension cables have sockets at each end, said sockets being pivotably connected to said first and second equalizer members.

12. The cable suspension means set forth in claim 10 wherein said equalizer members comprise flat plates having a plurality of bores therein.

13. The cable suspension means set forth in claim 10 further characterized by the arrangement between said equalizer members and said cables being such that each of the equalizer members is connected to two cables, the two cables being attached to one of said equalizer plates of said first pair being attached to separate of said equalizer plates of said second pair.

* * * * *